US006544058B1

(12) United States Patent
Chang

(10) Patent No.: US 6,544,058 B1
(45) Date of Patent: Apr. 8, 2003

(54) CHANGEABLE PLUG BASE STRUCTURE

(76) Inventor: Min-Chen Chang, No. 163, Ta-Chou Rd., Ta-She Village, Shen-Kang Hsang, Taichung Hsien (TW)

( * ) Notice: Subject to any disclaimer, the term of this patent is extended or adjusted under 35 U.S.C. 154(b) by 0 days.

(21) Appl. No.: 10/032,436

(22) Filed: Dec. 31, 2001

(51) Int. Cl.[7] ..... H01R 29/00
(52) U.S. Cl. ..... 439/173
(58) Field of Search ..... 439/171, 173, 439/174, 175, 170, 176, 108

(56) References Cited

U.S. PATENT DOCUMENTS 2,417,928 A * 3/1947 Guernsey ..... 439/173
2,450,657 A * 10/1948 Guernsey ..... 439/173
4,911,649 A * 3/1990 Helmich, Jr. ..... 439/173
5,613,863 A * 3/1997 Klaus et al. ..... 439/173
6,109,977 A * 8/2000 Baxter et al. ..... 439/171
6,227,888 B1 * 5/2001 Hahan ..... 439/173
6,328,581 B1 * 12/2001 Lee et al. ..... 439/171

* cited by examiner

*Primary Examiner*—Gary Paumen
(74) *Attorney, Agent, or Firm*—Charles E. Baxley

(57) ABSTRACT

A changeable plug base structure includes a universal terminal base disposed on an electronic device with first, second and third terminal pieces exposed from the surface thereof. A removable type insert plate is insertable into the universal terminal base, and has at least one positive terminal and one negative terminal secured thereon. The front side of the removable type insert plate displays the shapes of the terminals. The back side of the removable type insert plate is provided with terminal contact points corresponding to the first, second and third terminal pieces. The universal terminal base provides extensive terminal contact positions to permit contact with removable type insert plates of different specifications so that the user can select suitable removable type insert plates for use therewith.

13 Claims, 12 Drawing Sheets

CHANGEABLE PLUG BASE STRUCTURE

BACKGROUND OF THE INVENTION (a) Field of the Invention

The invention provides a universal terminal base on an electronic device (such as a charger, commutator, adapter, and power supply cable). The universal terminal base can be used in conjunction with removable type insert plates of different specifications so as to match different specifications of electrical appliances or electricity standards of different countries.

(b) Description of the Prior Art

Plugs and sockets connect electrical appliances with a power source. As the specifications of electrical appliances differ, there are different types of plugs and sockets. In general, adapters or connecting cables are required in order to connect to a power socket. In addition, the power supply specifications vary from country to country. Oftentimes, the plug and socket specifications used in one country are not applicable in another country. In case of such a problem, the most common solution is to use connecting cables or adapters. To cope with different types of matches, there are also different specifications of adapters and connecting cables, which are costly to develop and manufacture and which may not meet the demands for variety.

SUMMARY OF THE INVENTION

The primary object of the invention is to provide an changeable plug base structure, in which a universal terminal base is disposed on an electronic device to provide extensive terminal contact positions for receiving removable type insert plates having terminals of different specifications. The removable type insert plates are simple to change, inexpensive to manufacture, compact, convenient to carry, and can have different terminals according to different electricity specifications.

Another object of the invention is to provide a changeable plug base structure, the orientation of which can be changed to enable the user to adjust the orientations of the plug and the socket.

In order to achieve the above objects, the invention includes a universal terminal base disposed on an electronic device, with first, second and third terminal pieces exposed from the surface thereof. A removable type insert plate is insertable into the universal terminal base and has at least one positive terminal and one negative terminals secured thereon. The front side of the removable type insert plate displays the shapes of the terminals, while the back side is provided with terminal contact points for contacting the first, second and third terminal pieces.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
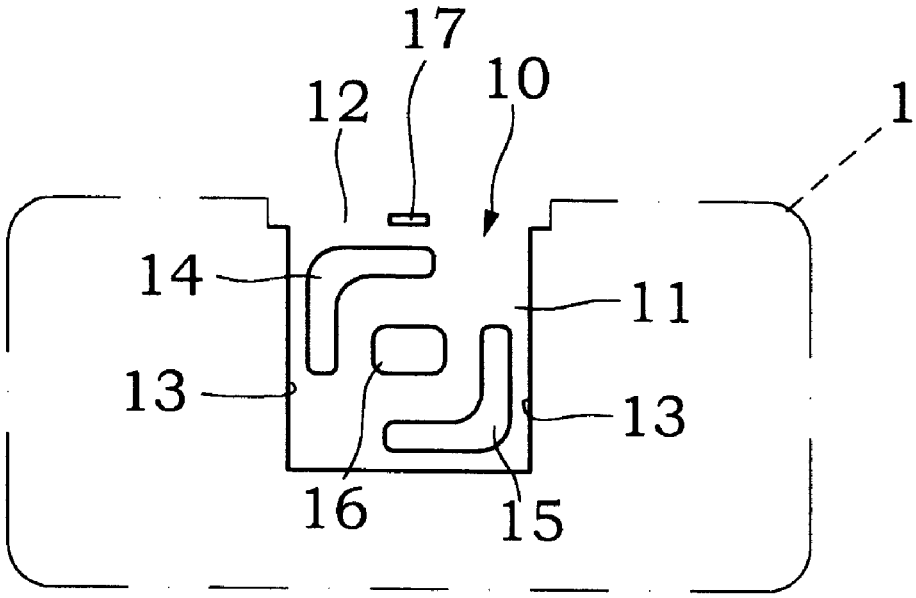
FIG. 1 is a plan view of a universal terminal base of the invention.

Referring to FIG. 1, a changeable plug base structure according to the invention includes a universal terminal base 10 and a removable type insert plate 20.

The universal terminal base 10 includes a substantially square recessed region 11 disposed in an electronic device 1. One edge of the recessed region 11 is provided with an opening 12, with the rest of the edges respectively provided with grooves 13. First, second and third terminal pieces 14, 15, 16 are embedded in the recessed region 11. The first and second terminal pieces 14, 15 are substantially bent and located at diagonally opposite corners of the recessed region 11. The third terminal pieces 16 is interposed between the first and second terminal pieces 14, 15. Each of the terminal pieces has a rear end concealed in the electronic device 1, and is connected to a conducting structure inside the electronic device 1. The recessed region 11 is further provided with a slightly protrudent positioning block 17.

The removable type insert plate 20 (shown in FIGS. 2, 3, 4, 5, 14, 15 and 16) is insertable into the grooves 13 so as to be disposed on the universal terminal base 10. The removable type insert plate 20 is a generally square plate with four edges that are respectively provided with insert edges 28 such that the removable type insert plate 20 can be turned and inserted into the grooves 13 from another direction, and is provided with two slightly recessed positioning grooves 29 for receiving the positioning block 17 such that the removable type insert plate 20 can be positioned on the universal terminal base 10 and such that the positioning block 17 can still engage the positioning groove 29 on the removable type insert plate 20 even if the latter is turned to change the orientation of the terminals. The removable type insert plate 20 wraps and secures positive and negative terminals 22, 23 and/or a grounding terminal 24 thereon (as shown in FIGS. 10A to 13B). These terminals can be configured to have different forms. To avoid use of too many reference numerals herein, the positive, negative and grounding terminals are all denotes by the reference numerals 22, 23, 24. The front side of the removable type insert plate 20 displays the essential shape of the terminals. The back side shows terminal contact points 25, 26, 27 covering the surface of the removable type insert plate 20. The arrangement and positions of the terminals, as well as the shapes of the terminals, vary according to the type of electrical appliance or the specification of each country. When the removable type insert plate 20 is inserted into the universal terminal base 10, the terminal contact points 25, 26 of the positive and negative terminals 22, 23 will contact the first and second terminal pieces 14, 15, respectively. The terminal contact point 27 of the grounding terminal 24 contacts the third terminal piece 16.

Figure 2:
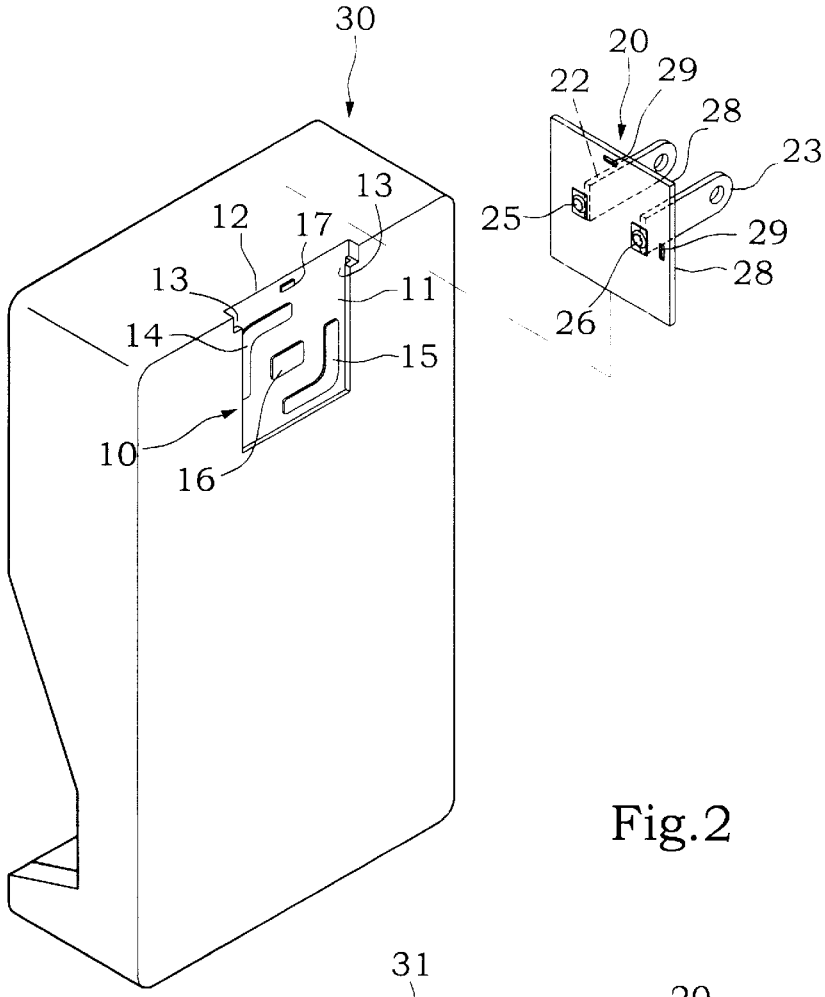
FIG. 2 is a perspective view of the universal terminal base of the invention when disposed in a conventional charger.
Figure 3:
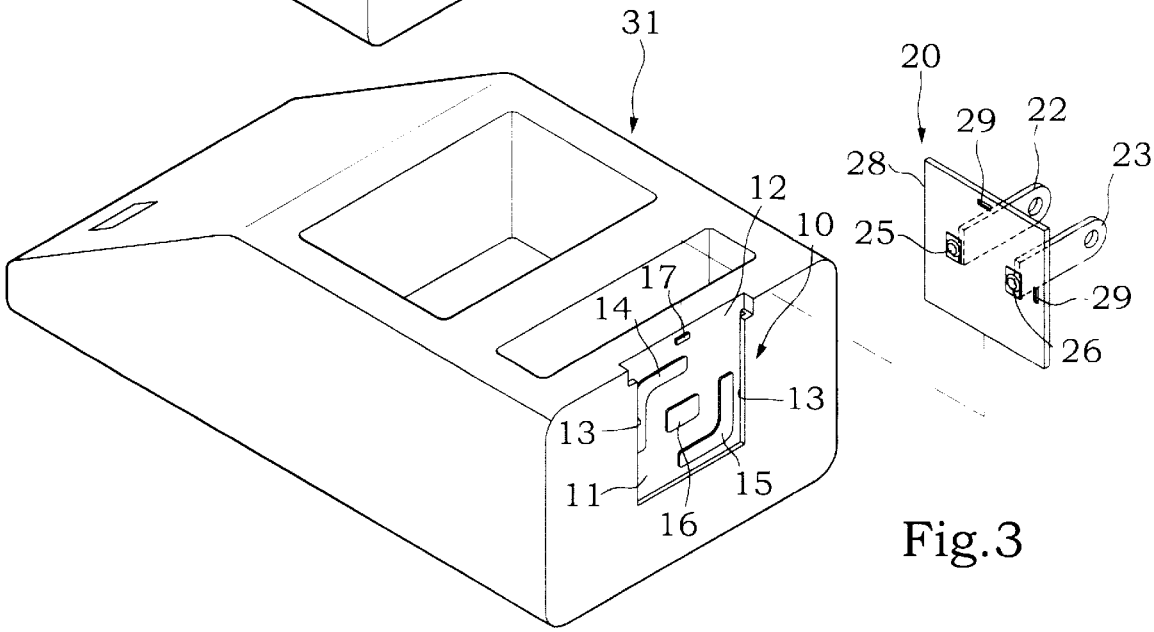
FIG. 3 is a perspective view of the universal terminal base of the invention when disposed in a mobile phone charger.
Figure 4:
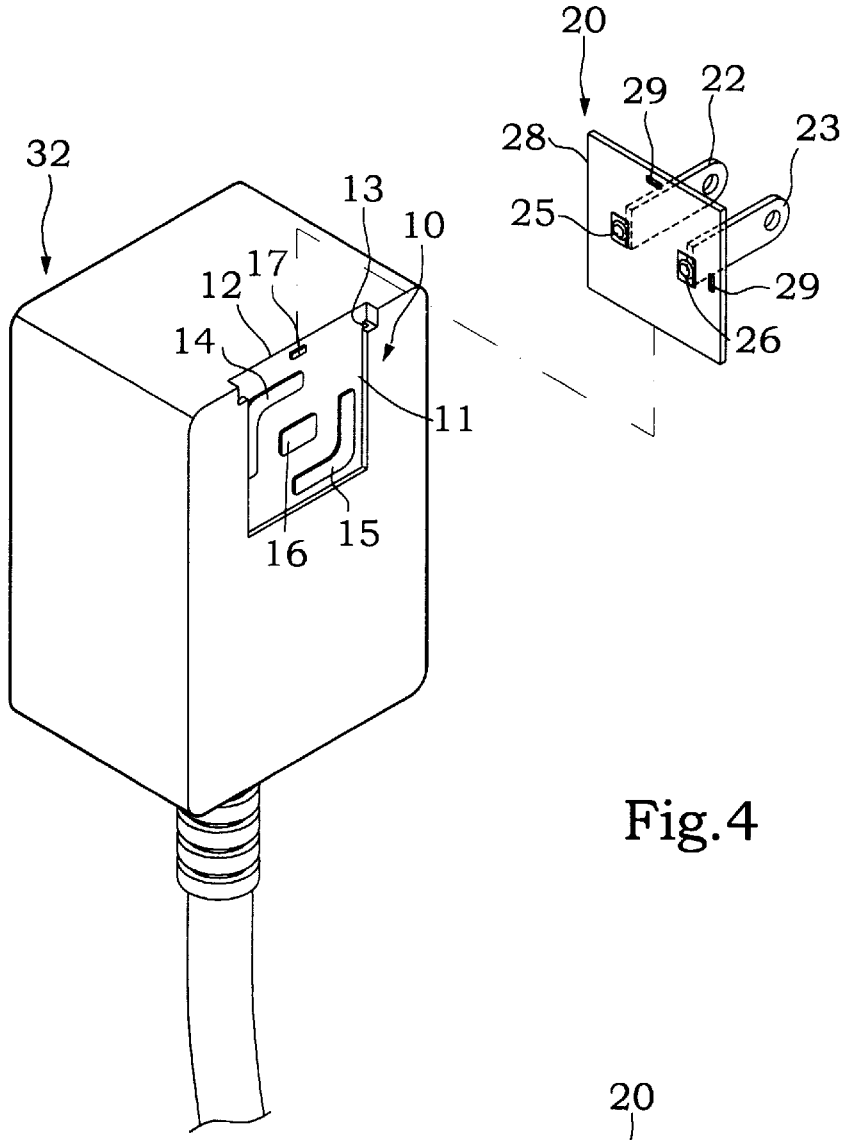
FIG. 4 is a perspective view of the universal terminal base of the invention when disposed in a commutator.
Figure 5:
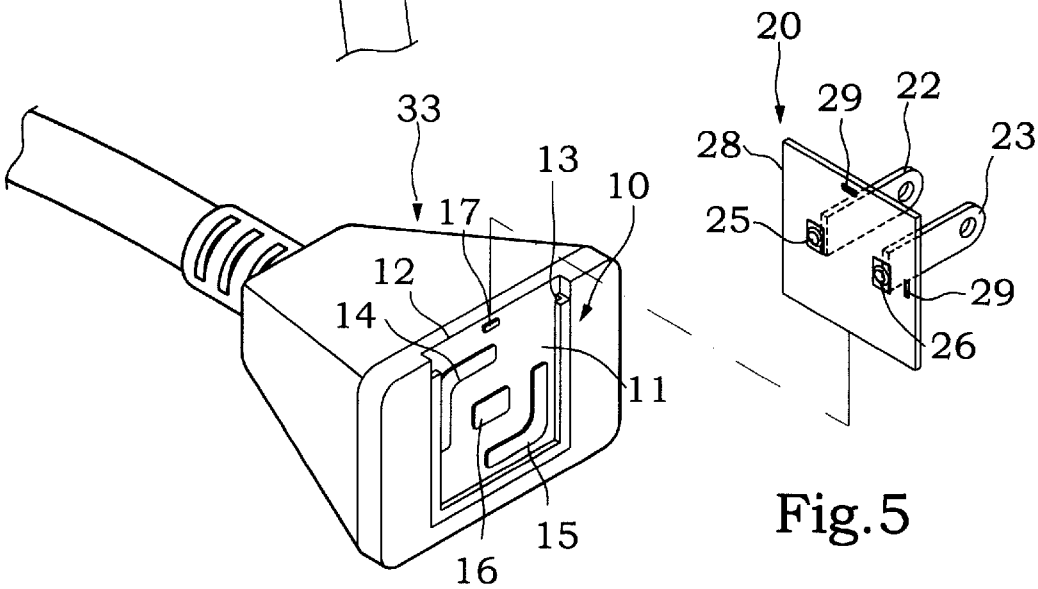
FIG. 5 is a perspective view of the universal terminal base of the invention when disposed on a power supply cable.
Figure 6A:
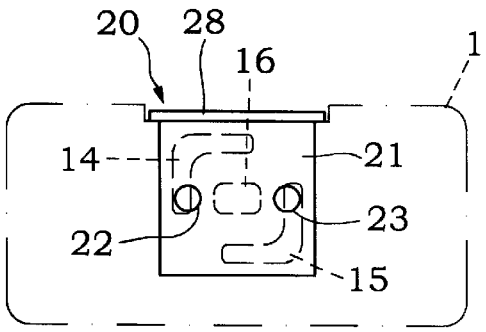
FIG. 6A is a plan assembled view of the universal terminal base of the invention and a removable type insert plate.
Figure 6B:
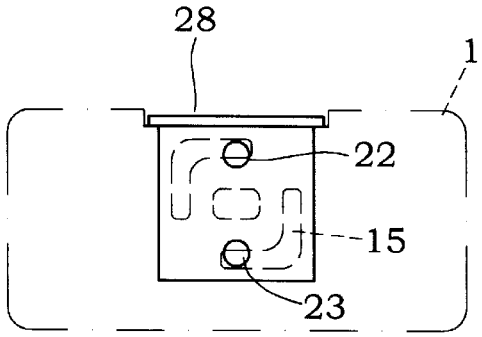
FIG. 6B is a plan assembled view of the universal terminal base of the invention and the removable type insert plate.
Figure 7A:
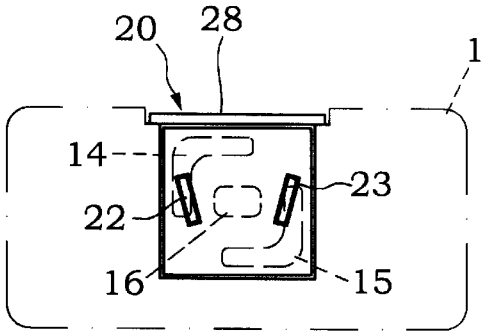
FIG. 7A is a plan assembled view of the universal terminal base of the invention and the removable type insert plate.
Figure 7B:
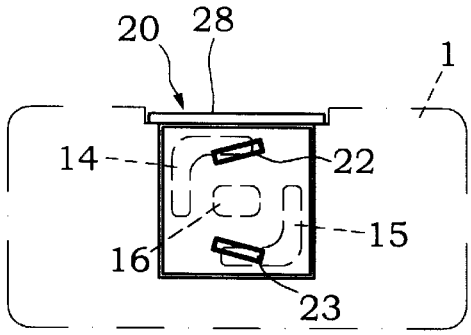
FIG. 7B is a plan assembled view of the universal terminal base of the invention and the removable type insert plate.
Figure 8A:
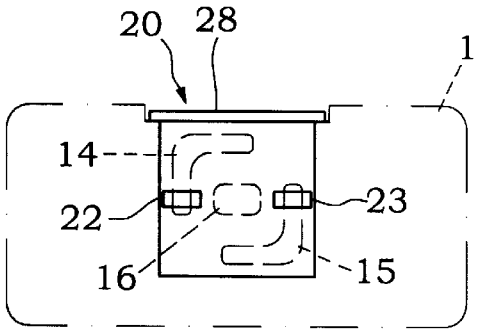
FIG. 8A is a plan assembled view of the universal terminal base of the invention and the removable type insert plate.
Figure 8B:
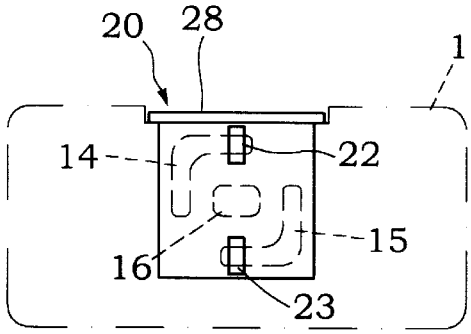
FIG. 8B is a plan assembled view of the universal terminal base of the invention and the removable type insert plate.
Figure 9A:
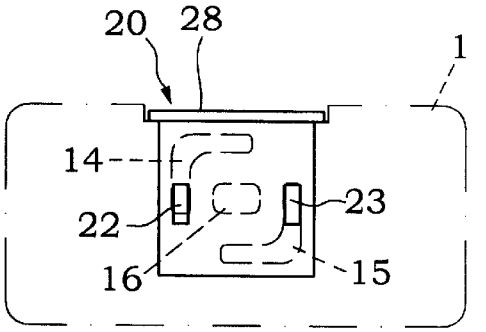
FIG. 9A is a plan assembled view of the universal terminal base of the invention and the removable type insert plate.
Figure 9B:
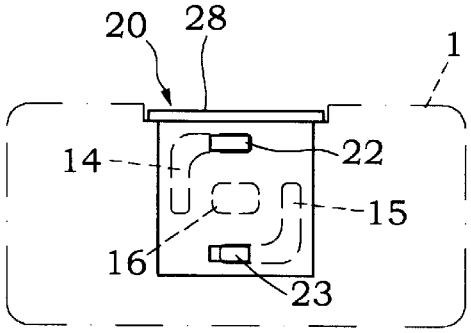
FIG. 9B is a plan assembled view of the universal terminal base of the invention and the removable type insert plate.
Figure 10A:
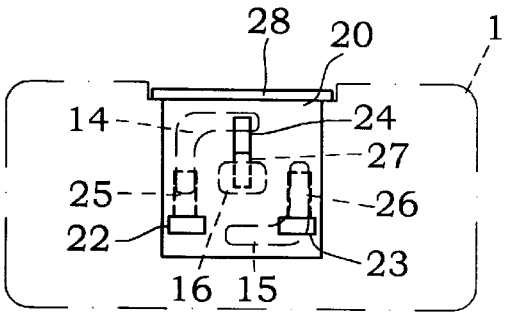
FIG. 10A is a plan assembled view of the universal terminal base of the invention and the removable type insert plate.
Figure 10B:
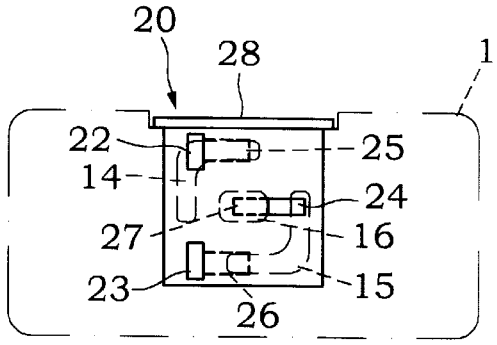
FIG. 10B is a plan assembled view of the universal terminal base of the invention and the removable type insert plate.
Figure 11A:
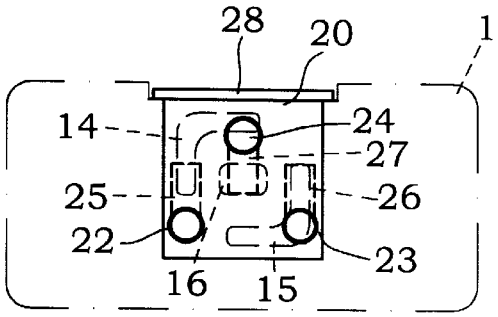
FIG. 11A is a plan assembled view of the universal terminal base of the invention and the removable type insert plate.
Figure 11B:
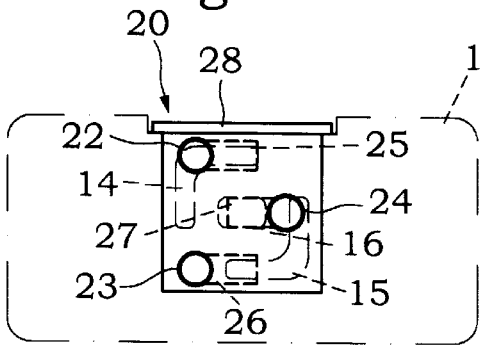
FIG. 11B is a plan assembled view of the universal terminal base of the invention and the removable type insert plate.
Figure 12A:
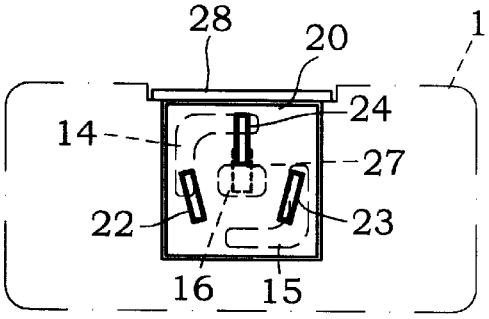
FIG. 12A is a plan assembled view of the universal terminal base of the invention and the removable type insert plate.
Figure 12B:
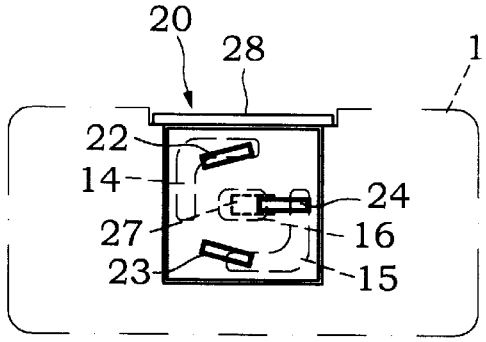
FIG. 12B is a plan assembled view of the universal terminal base of the invention and the removable type insert plate.
Figure 13A:
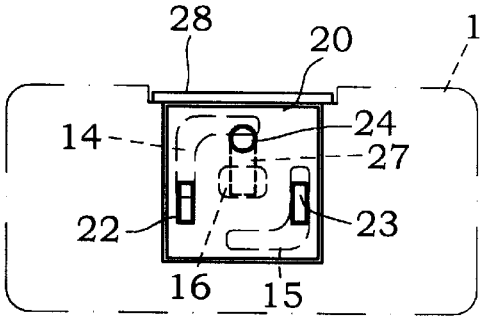
FIG. 13A is a plan assembled view of the universal terminal base of the invention and the removable type insert plate.
Figure 13B:
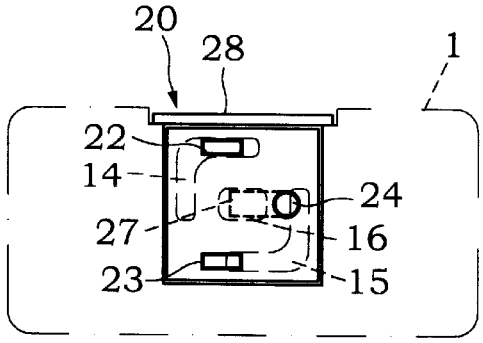
FIG. 13B is a plan assembled view of the universal terminal base of the invention and the removable type insert plate.

FIGS. 2, 3, 4 and 5 show that the universal terminal base 10 is disposed at a power position of the electronic device. In FIG. 2, the universal terminal base 10 is disposed on a conventional charger 30. In FIG. 3, the universal terminal base 10 is provided on a mobile phone charger 31. In FIG. 4, the universal terminal base 10 is disposed on a commutator 32. In FIG. 5, the universal terminal base 10 is disposed on a power supply cable.

FIGS. 6A, 6B to FIGS. 13A, 13B show that the removable type insert plate 20 can be formed to have different specifications. In the invention, the universal terminal base 10 and the removable type insert plate 20 are both square structures, and the removable type insert plate 20 has four sides provided with insert edges 28 so that it can be turned and inserted into the universal terminal base 10 from a different direction to change the orientation of the terminals thereon so as to adapt to different sockets, thereby facilitating use.

Figure 14:
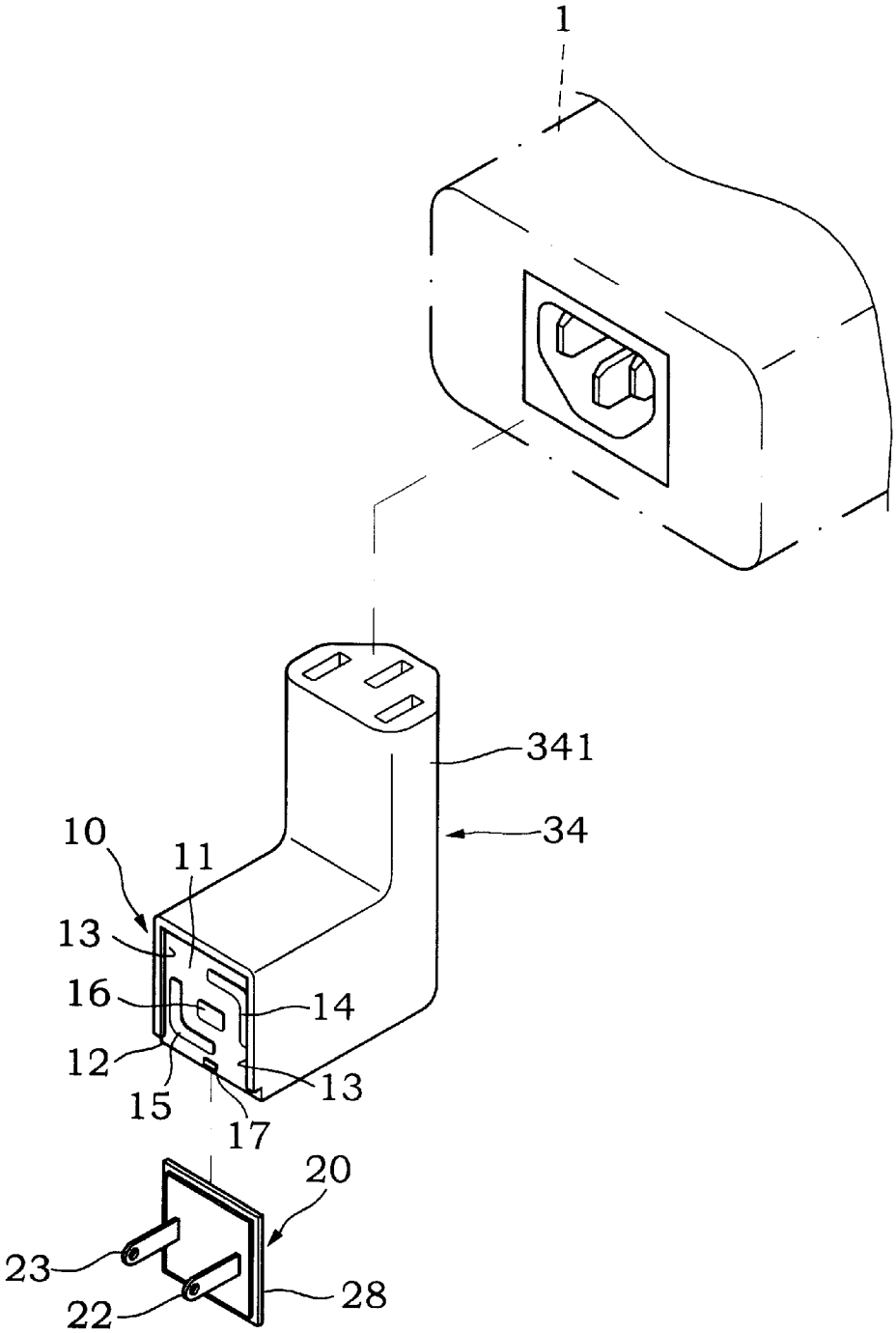
FIG. 14 is a perspective view of the universal terminal base of the invention when disposed on an L-shaped adapter.
Figure 15:
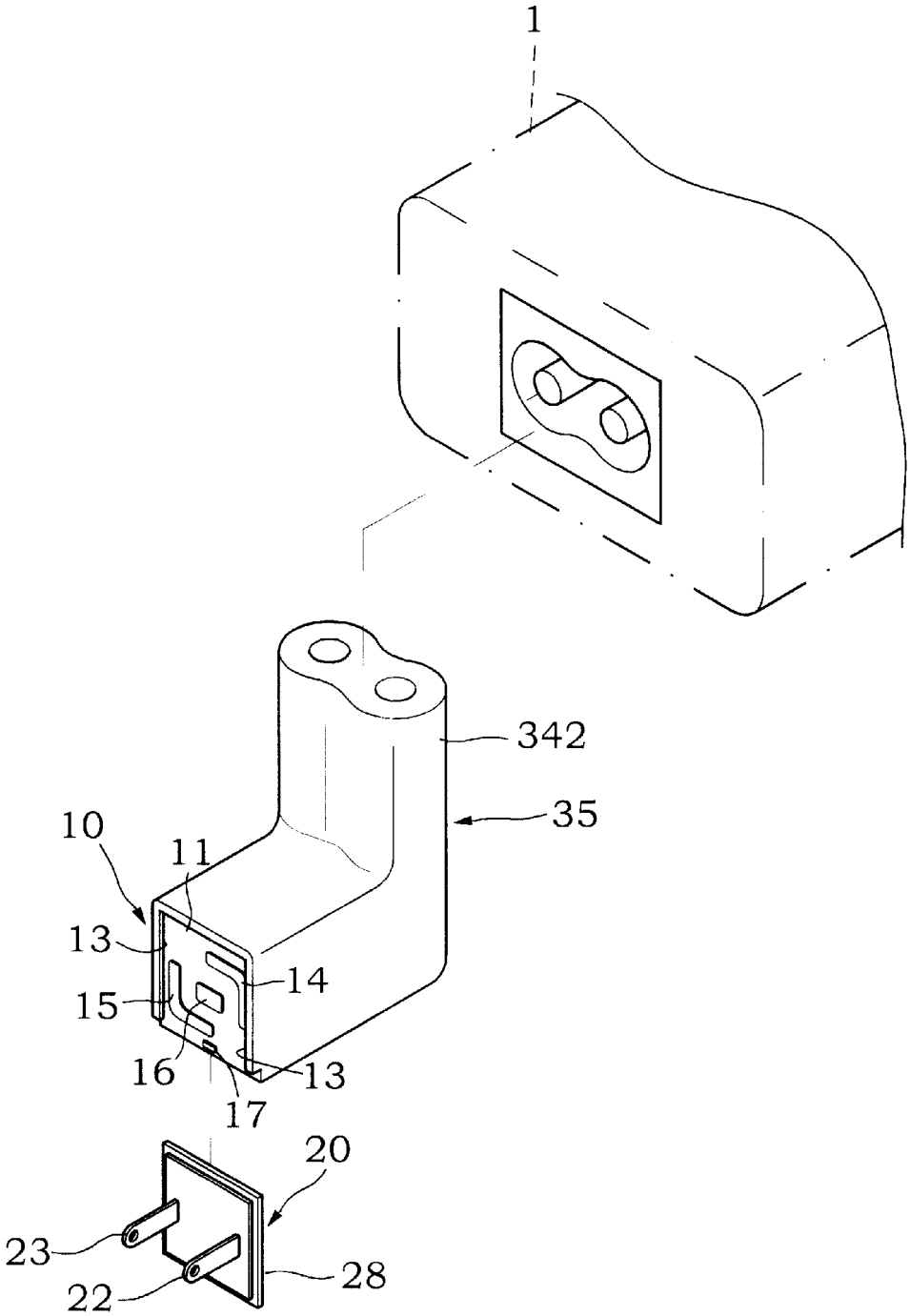
FIG. 15 is a perspective view of the universal terminal base of the invention when disposed on an L-shaped adapter.
Figure 16:
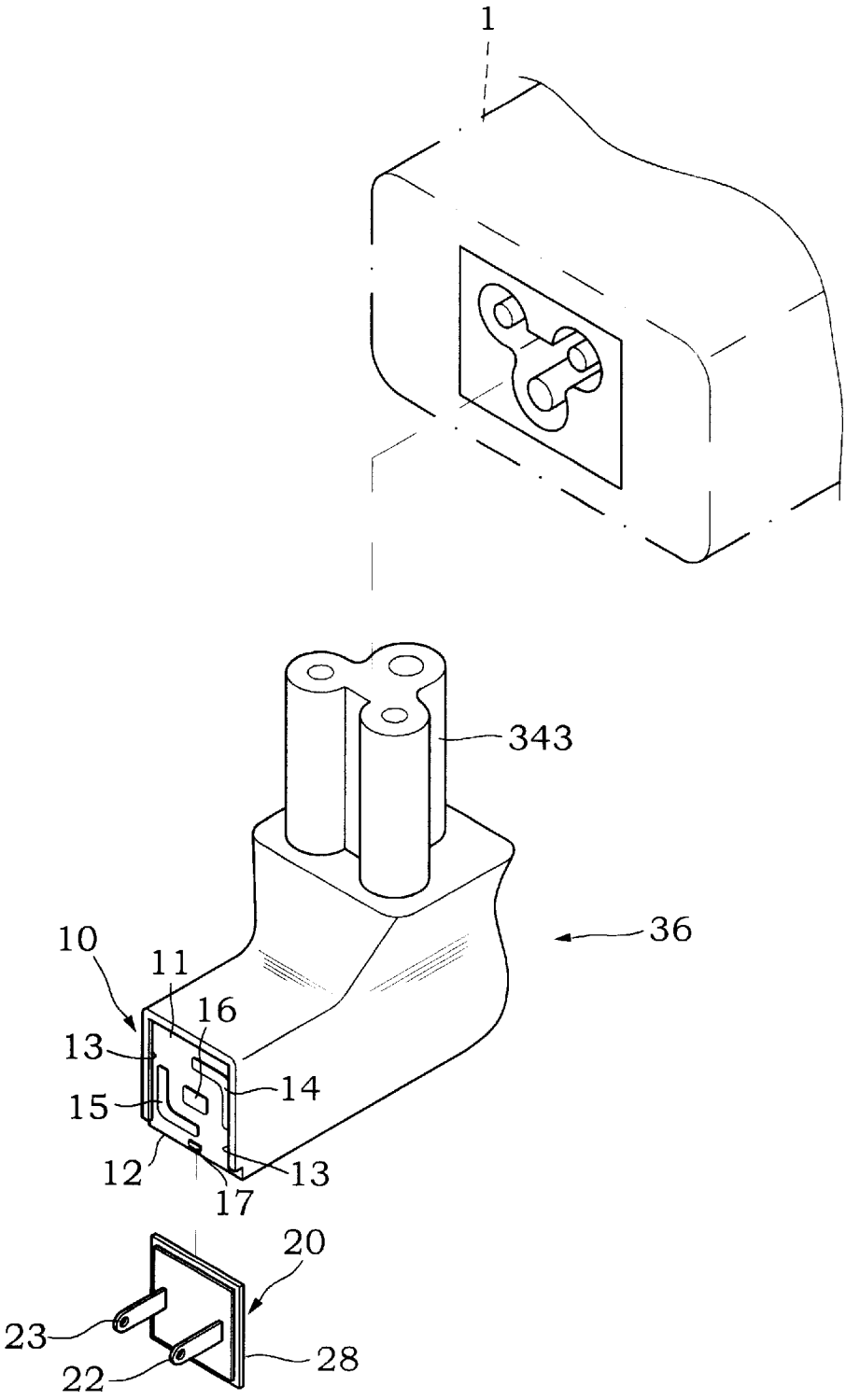
FIG. 16 is a perspective view of the universal terminal base of the invention when disposed on an L-shaped adapter.

FIGS. 14, 15 illustrate that the universal terminal base 10 of the invention is adapted for use in L-shaped adapters 34, 35, 36. One end of the adapter 34, 35, 36 is a socket portion 341, 342, 343 of a different type, and the other end is the universal terminal base 10.

Figure 17:
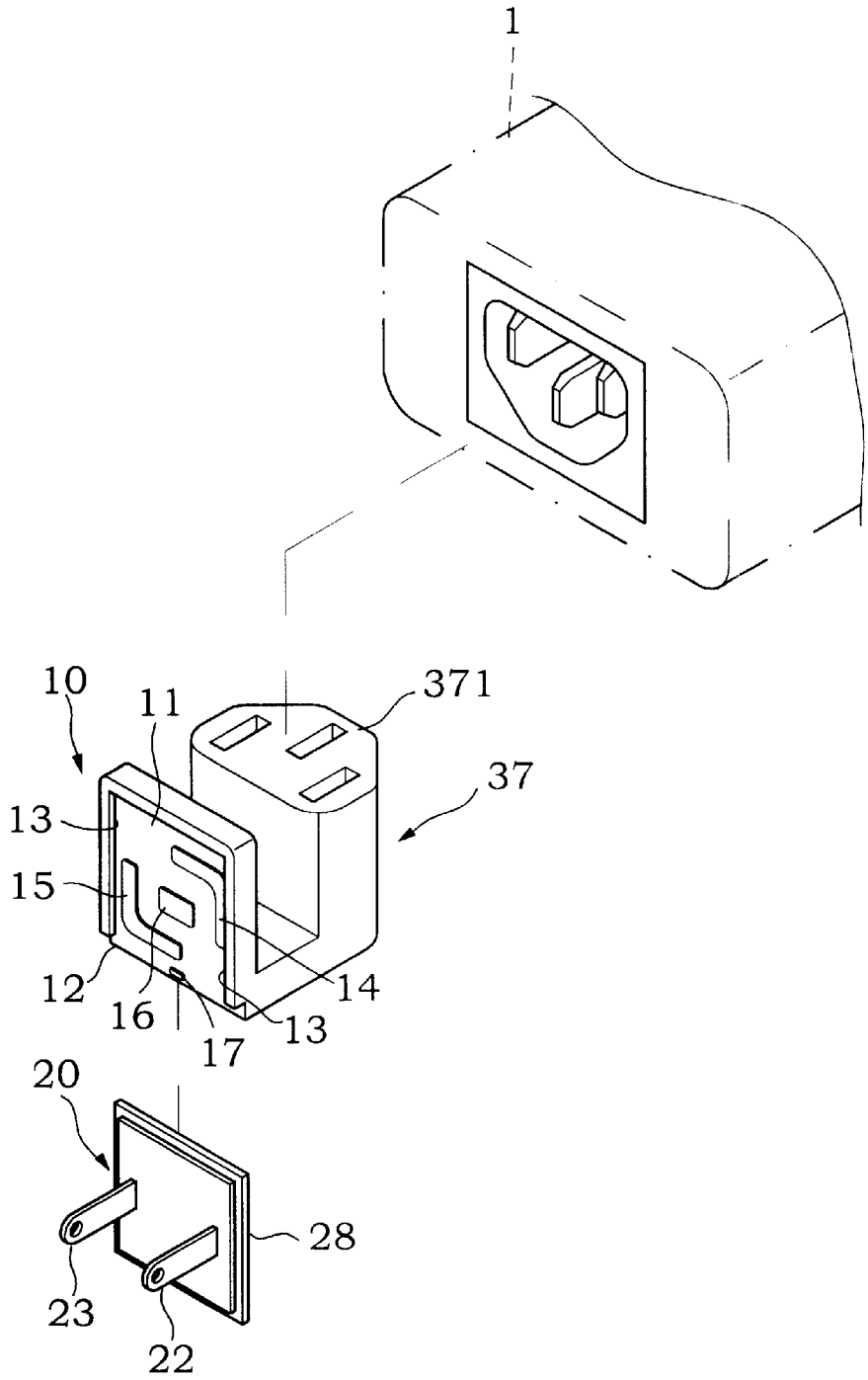
FIG. 17 is a perspective view of the universal terminal base of the invention when disposed on a U-shaped adapter.
Figure 18:
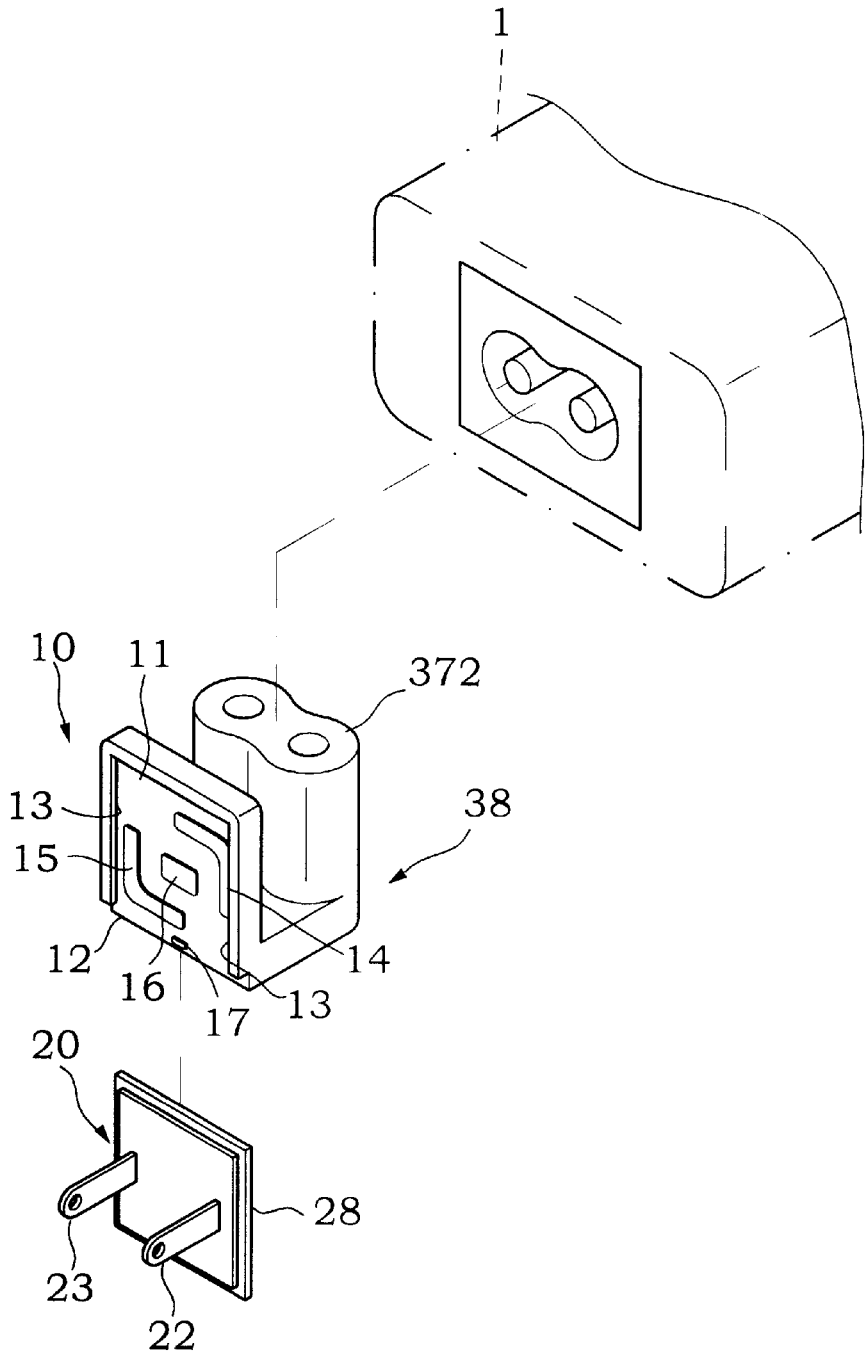
FIG. 18 is a perspective view of the universal terminal base of the invention when disposed on a U-shaped adapter.
Figure 19:
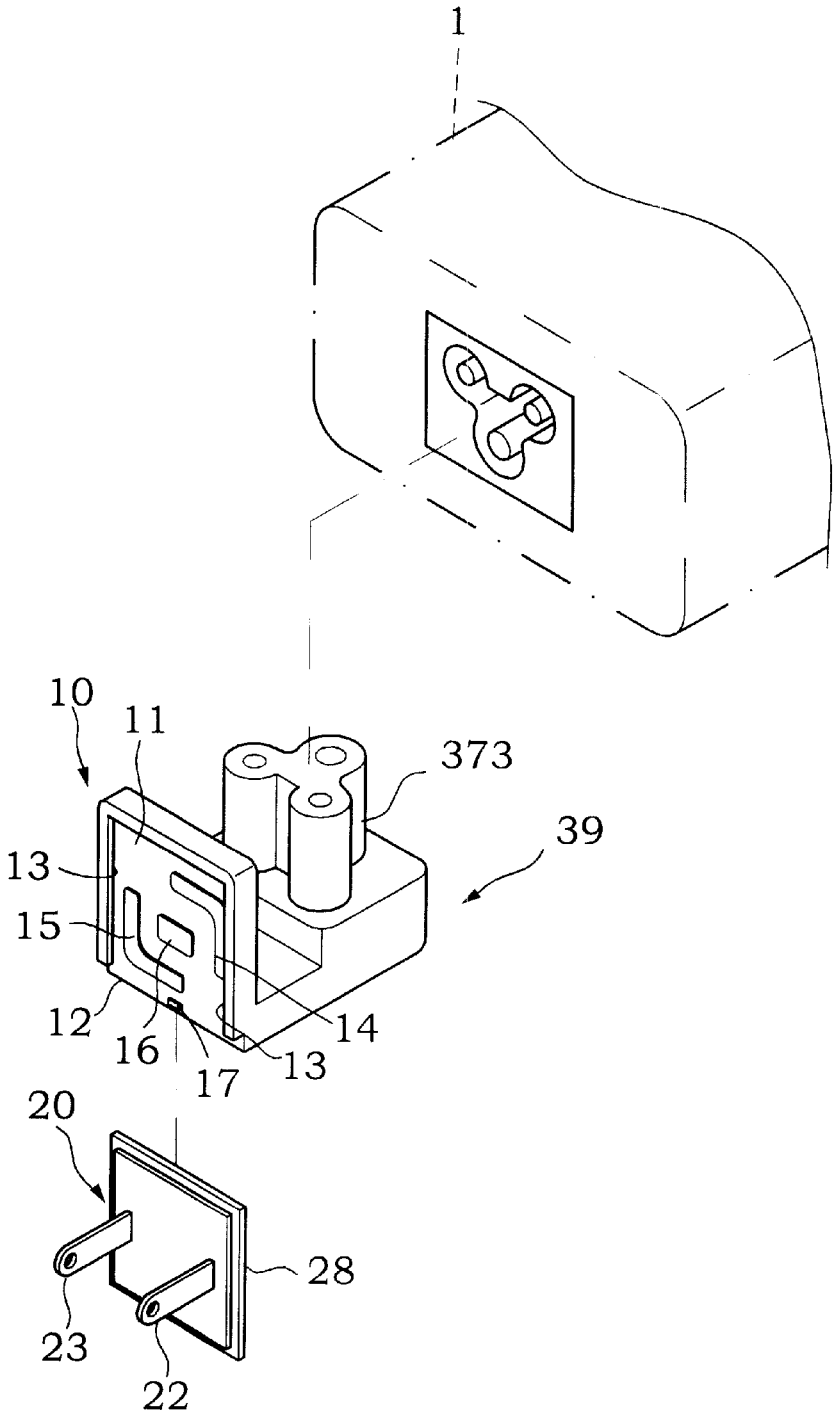
FIG. 19 is a perspective view of the universal terminal base of the invention when disposed on a U-shaped adapter.

FIGS. 17, 18, 19 show that the universal terminal base 10 of the invention is adapted for use in U-shaped adapters 37, 38, 39. One end of the adapter 37, 38, 39 is a socket portion 371, 382, 393 of a different type, and the other end is the universal terminal base 10.

Figure 20:
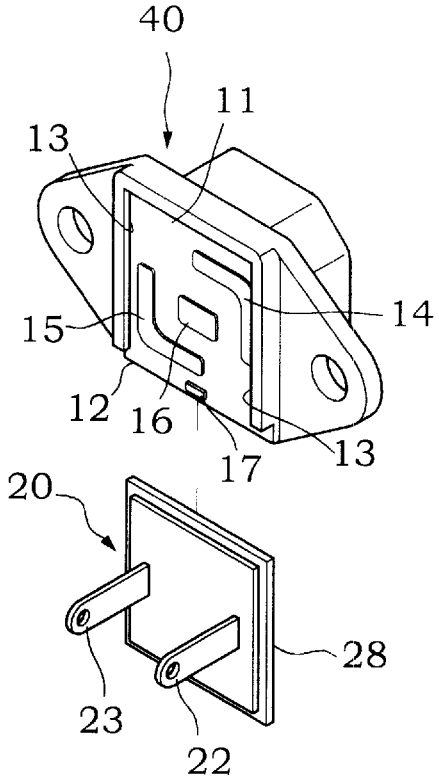
FIG. 20 is a perspective view of the universal terminal base of the invention when disposed on a power supply seat.
Figure 21:
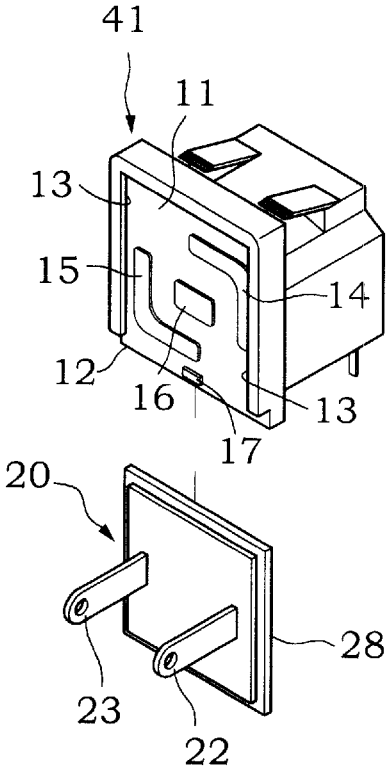
FIG. 21 is a perspective view of the universal terminal base of the invention when disposed on a power supply seat.

FIGS. 20 and 21 shows that the universal terminal base 10 of the invention is adapted for use in a power supply seat 40, 41, which is insertably or lockably disposed in a recess in a predetermined power supply end of an electronic device.

As the scope of application of the universal terminal base 10 of the invention is extensive, and the specifications of the removable type insert plate 20 cooperating therewith are many to enumerate, the examples provided herein and illustrated in the drawings are for illustration purposes and should not limit the scope of the invention.

The universal terminal base 10 of the invention provides extensive terminal contact positions to permit contact with removable type insert plates 20 of conventional standards. In the case that the arrangement of the terminals are such that the terminal contact points 25, 26, 27 cannot contact the terminal pieces 14, 15, 16, the contact areas of the terminal contact points 25, 26, 27 can be increased by extending or enlarging the area such as that shown in FIGS. 10A, 10B, 11A, 11B, 13A, and 13B to resolve the problem of contact between the terminal pieces and the contact points. The changing of the removable type insert plates 20 is simple. The removable type insert plates are low-cost, compact, and convenient to carry, and has wide adaptability, i.e., different removable type insert plates can be adopted to comply with local electricity specifications. In addition, the orientation of the removable type insert plates 20 can be changed to match the orientation of the socket.

What is claimed is:

1. A changeable type plug base structure comprising:

a universal terminal base including a recessed region provided on a surface of an electronic device, said recessed region having one edge formed with an opening, and first, second and third terminal pieces disposed therein:

a removable type insert plate having at least one positive terminal and one negative terminal and one ground terminal, said removable type insert plate having a front side displaying shapes of said terminals and a back side providing with a plurality of terminal contact points, said removable type insert plate being insertable into said recessed region via said opening such that said plurality of terminal contact points contact said first, second and third terminal pieces.

2. The changeable plug base structure as claimed in claim 1, wherein said recessed region is a square-shaped region.

3. The changeable plug base structure as claimed in claim 2, wherein said removable type insert plate is a square-shaped plate.

4. The changeable plug base structure as claimed in claim 1, wherein said recessed region is provided with a slightly protrudent positioning block, said back side of removable type insert plate having two adjacent edges provided with slightly recessed positioning grooves for receiving said positioning block.

5. The changeable plug base structure as claimed in claim 1, wherein said first and second terminal pieces each have a bent shape and are located at two end corners of said universal terminal base, with said third terminal piece being interposed between said first and second terminal pieces.

6. The changeable plug base structure as claimed in claim 1, wherein said electronic device is a charger.

7. The changeable plug base structure as claimed in claim 1, wherein said electronic device is a commutator.

8. The changeable plug base structure as claimed in claim 1, wherein said electronic device is a power supply cable.

9. The changeable plug base structure as claimed in claim 1, further comprising an L-shaped adapter having an end portion wherein said universal terminal base is disposed at said end portion of said L-shaped adapter.

10. The changeable plug base structure as claimed in claim 1, wherein said universal terminal base is disposed at an end portion of a U-shaped adapter.

11. The changeable plug base structure as claimed in claim 1, wherein said universal terminal base is disposed on a power supply seat.

12. A changeable type plug base structure, comprising:

a universal terminal base including a recessed region provided on a surface of an electronic device, said recessed region having one edge formed with an opening, and first, second and third terminal pieces disposed therein;

a removable type insert plate having at least one positive terminal one negative terminal, and one ground terminal said removable type insert plate having a front side displaying shapes of said terminals, and a back side provided with a plurality of terminal contact points, said removable type insert plate being insertable into said recessed region via said opening such that said terminal contact points contact said first, second and third terminal pieces, wherein said recessed region is a square-shaped region and wherein said recessed region has one edge provided with said opening, the rest of the edges being provided with grooves.

13. The changeable plug base structure as claimed in claim 12 wherein said removable type insert plate has four edges respectively provided with insert edges for slidable insertion into and positioning in said grooves, respectively.

* * * * *